US011220891B2

(12) United States Patent
Metzger et al.

(10) Patent No.: US 11,220,891 B2
(45) Date of Patent: Jan. 11, 2022

(54) SHAPED CHARGE WITH TRI-RADII LINER FOR OILFIELD PERFORATING

(71) Applicant: Halliburton Energy Services, Inc., Houston, TX (US)

(72) Inventors: Jason Paul Metzger, Joshua, TX (US); Steve Shih-Hsiang Lin, Fort Worth, TX (US); Brenden Michael Grove, Mansfield, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/976,713

(22) PCT Filed: Jun. 21, 2018

(86) PCT No.: PCT/US2018/038831
§ 371 (c)(1),
(2) Date: Aug. 28, 2020

(87) PCT Pub. No.: WO2019/245569
PCT Pub. Date: Dec. 26, 2019

(65) Prior Publication Data

US 2020/0408075 A1 Dec. 31, 2020

(51) Int. Cl.
*E21B 43/117* (2006.01)
*F42B 1/028* (2006.01)

(52) U.S. Cl.
CPC ..... *E21B 43/117* (2013.01); *F42B 1/028* (2013.01)

(58) Field of Classification Search
CPC ..... E21B 43/1117
See application file for complete search history.

(56) References Cited

U.S. PATENT DOCUMENTS 2,856,850 A * 10/1958 Church ..... F42C 19/09 102/307
3,478,685 A * 11/1969 Thomanek ..... F42B 1/028 102/306
4,436,033 A * 3/1984 Precoul ..... F42B 1/028 102/307

(Continued)

FOREIGN PATENT DOCUMENTS

KR 100930374 B1 12/2009

OTHER PUBLICATIONS

International Search Report and Written Opinion issued in corresponding International Application No. PCT/US2018/038831, dated Mar. 14, 2019.

*Primary Examiner* — Taras P Bemko
(74) *Attorney, Agent, or Firm* — McGuire Woods LLP

(57) ABSTRACT

Provided are liners for a shaped charge and corresponding methods of use. An example liner comprises a generally conical shape having an apex, an open side, a liner wall comprising a thickness, and an axis extending through the center of the liner from the apex to the center of the open side. The liner comprises a liner height extending in a vertical plane from the center of the open side to the apex, a liner radius extending along a horizontal plane that is perpendicular to the axis at the open side of the liner and that extends from the axis to an outermost edge of the liner wall. The ratio of the liner height to the liner diameter is about 0.90 to about 1.10. The liner wall comprises an apex curvature, a first wall curvature, a second wall curvature, and a third wall curvature.

20 Claims, 6 Drawing Sheets

(56) References Cited

U.S. PATENT DOCUMENTS

| | | | | |
|---|---|---|---|---|
| 5,614,692 | A * | 3/1997 | Brown | F42B 1/028 102/307 |
| 6,840,178 | B2 | 1/2005 | Collins et al. | |
| 9,470,483 | B1 * | 10/2016 | Wang | F42B 3/22 |
| 9,803,455 | B1 | 10/2017 | Yang et al. | |
| 9,951,589 | B2 * | 4/2018 | Wilson | F42B 3/08 |
| 10,041,337 | B2 * | 8/2018 | Walker | E21B 43/117 |
| 2001/0052303 | A1 | 12/2001 | Mayseless et al. | |
| 2002/0017214 | A1 | 2/2002 | Jacoby et al. | |
| 2003/0183113 | A1 | 10/2003 | Barlow et al. | |
| 2012/0024180 | A1 | 2/2012 | Waddell et al. | |
| 2017/0199016 | A1 | 7/2017 | Collins et al. | |

* cited by examiner

SHAPED CHARGE WITH TRI-RADII LINER FOR OILFIELD PERFORATING

TECHNICAL FIELD

The present disclosure relates to shaped charge liners for oilfield perforating, and more particularly, to a shaped charge having a tri-radii liner for minimizing casing hole variation in a casing without the need to centralize the shaped charge carrier in the casing.

BACKGROUND

After drilling of a wellbore traversing a formation, a casing string may be positioned and cemented within the wellbore. This casing string may increase the integrity of the wellbore and may provide a path for producing fluids from the producing intervals to the surface. To allow fluid flow into the casing string, perforations may be made through the casing string, the cement, and a distance into the formation.

These perforations may be created by detonating a series of shaped charges disposed within the casing string and adjacent to the formation. Specifically, one or more carriers (e.g., a perforating gun) may be loaded with shaped charges that may be connected with a detonator via a detonating cord. The carrier may then be attached to a tool string that is lowered into the cased wellbore. Once the carrier is properly positioned in the wellbore such that the shaped charges are at a depth that positions them adjacent to the target formation, the shaped charges may be detonated, creating the desired perforations.

Generally, a shaped charge includes a charge case containing an explosive load disposed within, and a shaped liner disposed adjacent to the explosive load. The shape of the explosive load and the shaped liner may determine the shape of a high-pressure, high-velocity jet generated by the detonation of the explosive load and the subsequent collapse of the shaped liner. This jet determines the overall performance characteristics of the shaped charge. The jet may cause materials such as steel, cement, and rock formations to flow plastically around the jet path, thereby creating the desired perforation tunnel in the casing, cement, and surrounding formation.

A typical shaped charge is carried in a carrier. In some wells it may be desirable to use a carrier that is decentralized in the casing. However, when the carrier is decentralized, the shaped charges on one side of the carrier may be a different distance to the casing than on the other side of the carrier. As such, it can be difficult to accurately control the casing hole diameter formed by each shaped charge. It may be desirable to reduce the variation in casing hole diameter among the shaped charges. For example, variation in the casing hole diameter may result in unequal pressure and flow through each casing hole for subsequent operations. Failure to minimize the casing hole diameter variation in the casing may result in uneven flow and therefore uneven stimulation in subsequent operations.

BRIEF DESCRIPTION OF THE DRAWINGS

Illustrative examples of the present disclosure are described in detail below with reference to the attached drawing figures, which are incorporated by reference herein, and wherein.

Figure 1:
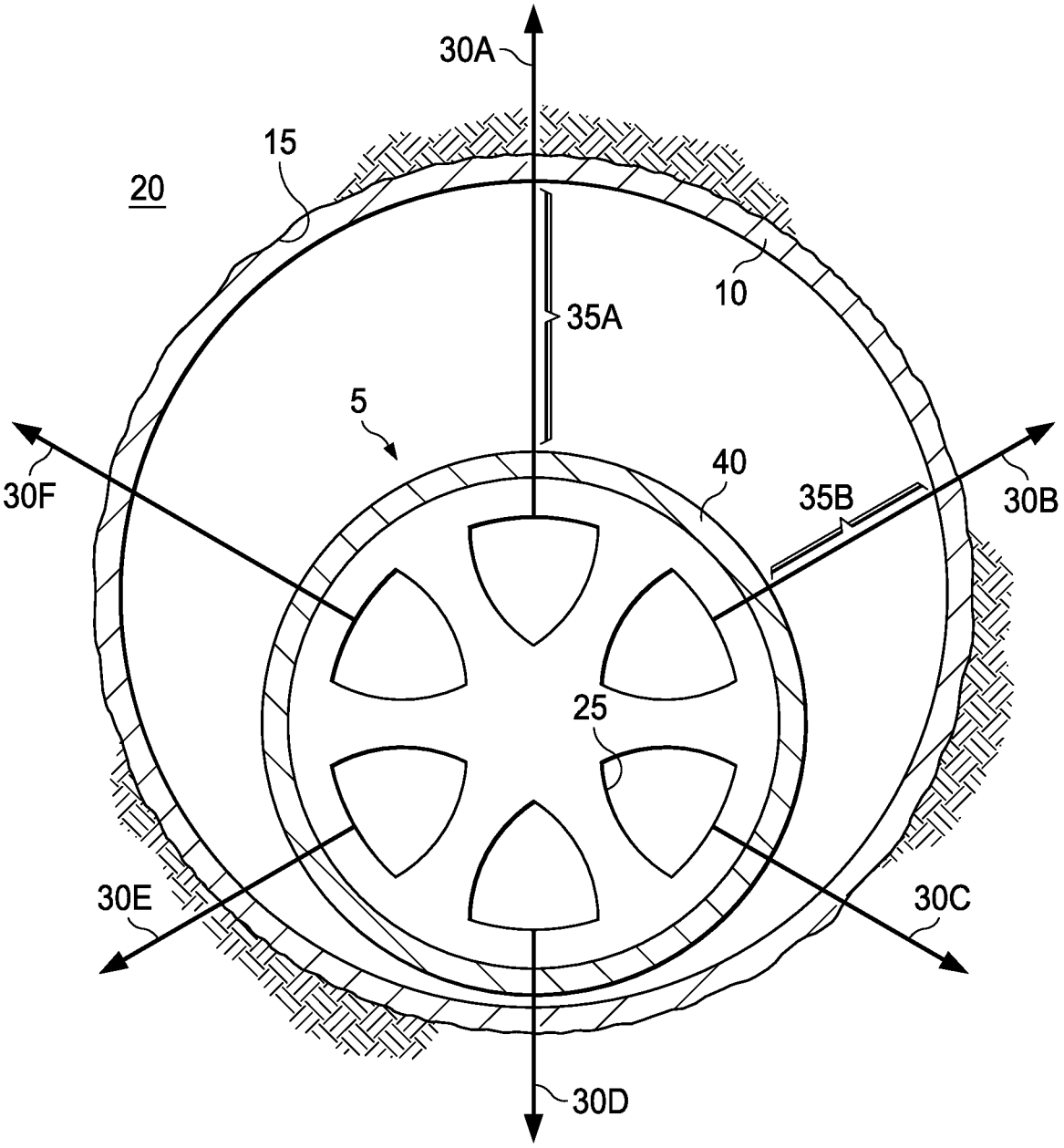
FIG. 1 is a cross-section illustrating an example perforating system disposed within a casing in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates to shaped charge liners for oilfield perforating, and more particularly, to a shaped charge having a tri-radii liner for minimizing casing hole variation in a casing without the need to centralize the shaped charge carrier in the casing.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Examples of the methods and systems described herein relate to perforating downhole casing using a shaped charge having a specific liner geometry. Advantageously, the liner geometry of the shaped charge minimizes casing hole variation in decentralized carriers. As such, the liner geometry reduces casing hole variation amongst the casing holes formed in the casing thereby reducing uneven flow through said casing holes. Further advantageously, the shaped charge liner may be used with any of the casings, explosives, liner powder, and perforating systems presently used in the field. Finally, the shaped charge liner may be used to perforate a variety of casing sizes and grades presently used in the field.

As used herein, "casing hole" refers to the through hole or thru-hole perforation formed in the casing from a shaped charge. As the casing has a depth, the diameter of the casing hole may vary along that depth. As the smallest diameter along the casing hole controls the rate of egress/ingress through the casing hole, it is to be understood that "casing hole diameter" and "casing hole diameter variation" refers to the smallest diameter of the casing hole.

FIG. 1 is cross-section illustrating an example perforating system 5 disposed within a casing 10. The perforating system 5 may be disposed on a distal end of work string. It should be noted that the principles described herein are equally applicable to land-based systems or subsea systems without departing from the scope of the disclosure. Casing 10 is disposed in a wellbore 15 penetrating a subterranean formation 20. Wellbore 15 may extend through the various earth strata comprising subterranean formation 20. Wellbore 15 may include horizontal, vertical, slanted, curved, and other types of wellbore geometries and orientations, as will be appreciated by those of ordinary skill in the art. In some examples, the casing 10 may be cemented within wellbore 15. When it is desired to perforate casing 10, for example, to stimulate the adjacent subterranean formation 20, the perforating system 5 may be lowered through casing 10 until the perforating system 5 is at a depth where it is properly positioned relative to the targeted subterranean formation 20. The perforating system 5 may be attached to and lowered via a work string (not illustrated), which may include a tubing string, wireline, slick line, coil tubing or other conveyance.

The perforating system 5 may comprise a carrier 40. As illustrated, the carrier 40 may be in the form of a cylindrical sleeve. The carrier 40 may comprise a plurality of shaped charge holding recesses, which hold the shaped charges 25 in a desired orientation. The carrier 40 may be decentralized in the casing 10. The plurality of shaped charges 25 may be arranged in a spiral pattern such that each of the shaped charges 25 may be disposed on its own level or height and may be individually detonated so that only one shaped charge 25 may be fired at a time. Alternate arrangements of the plurality of shaped charges 25 may be used, including cluster-type designs wherein more than one shaped charge 25 may be at the same level and may be detonated at the same time. Upon ignition, shaped charges 25 may generate a jet that may penetrate casing 10.

As discussed, the perforating system 5 comprises at least one shaped charge 25. In the illustrated example, six shaped charges 25 are disposed in the interior of the carrier 40 (e.g., a perforating gun) of the perforating system 5 and arranged in a cluster-type design that is arranged circumferentially in the interior of the carrier 40. Although six shaped charges 25 are illustrated, it is to be understood that any number of shaped charges 25 may be used and arranged in the carrier 40 as described. The shaped charges 25 may be disposed in the carrier 40 to be immediately adjacent to one another in a radially extending plane as illustrated and/or the shaped charges 25 may be distributed axially in the casing 10, that is uphole/downhole from other adjacent shaped charges 25 in the same or in different orientations (e.g., in a helical or linear arrangement as discussed above). With the benefit of this disclosure, one of ordinary skill in the art will be readily able to determine a desired distribution and arrangement for the shaped charges 25.

When positioned as desired, the shaped charges 25 within the perforating system 5 may be detonated in a desired firing sequence or detonated simultaneously. As will be discussed in more detail below, an explosive component contained within the shaped charges 25 may be detonated which may induce the rapid collapse of a liner within each individual shaped charge 25. The collapsing liner is propelled forward forming a jet that may be powerful enough to perforate the surrounding casing 10 thereby forming a casing hole in the casing 10. The jet may continue to extend outward also perforating any surrounding cement sheath as well as the subterranean formation 20.

With continued reference to FIG. 1, the jets may exit the shaped charges 25 in the directions illustrated by arrows 30A-30F. The orientation of the shaped charges 25 determines the direction each individual jet travels as represented by arrows 30A-30F. Moreover, as the carrier 40 is decentralized in the casing 10, the distance the jets travel to contact casing 10 varies based on the orientation and location of the shaped charge 25 within the decentralized carrier 40. For example, the shaped charge 25 firing a jet in the direction of 30A will form a jet that must travel distance 35A to contact casing 10, whereas the shaped charge 25 firing a jet in the direction of 30B will form a jet that must travel distance 35B to contact casing 10. Although the illustration of FIG. 1 is not to scale, it is to be understood that distance 35A is longer than distance 35B. This difference may result in a variation in the diameter of the casing hole formed in casing 10. A difference in casing hole diameter may result in a different rate of flow through the casing hole. Advantageously, the shaped charges 25 disclosed herein may reduce this variation in casing hole diameter in decentralized perforating system 5.

It should be clearly understood that the example of perforating system 5 illustrated by FIG. 1 is merely a general application of the principles of this disclosure in practice, and a wide variety of other examples are possible. Therefore, the scope of this disclosure is not limited in any manner to the details of FIG. 1 as described herein.

Figure 2:
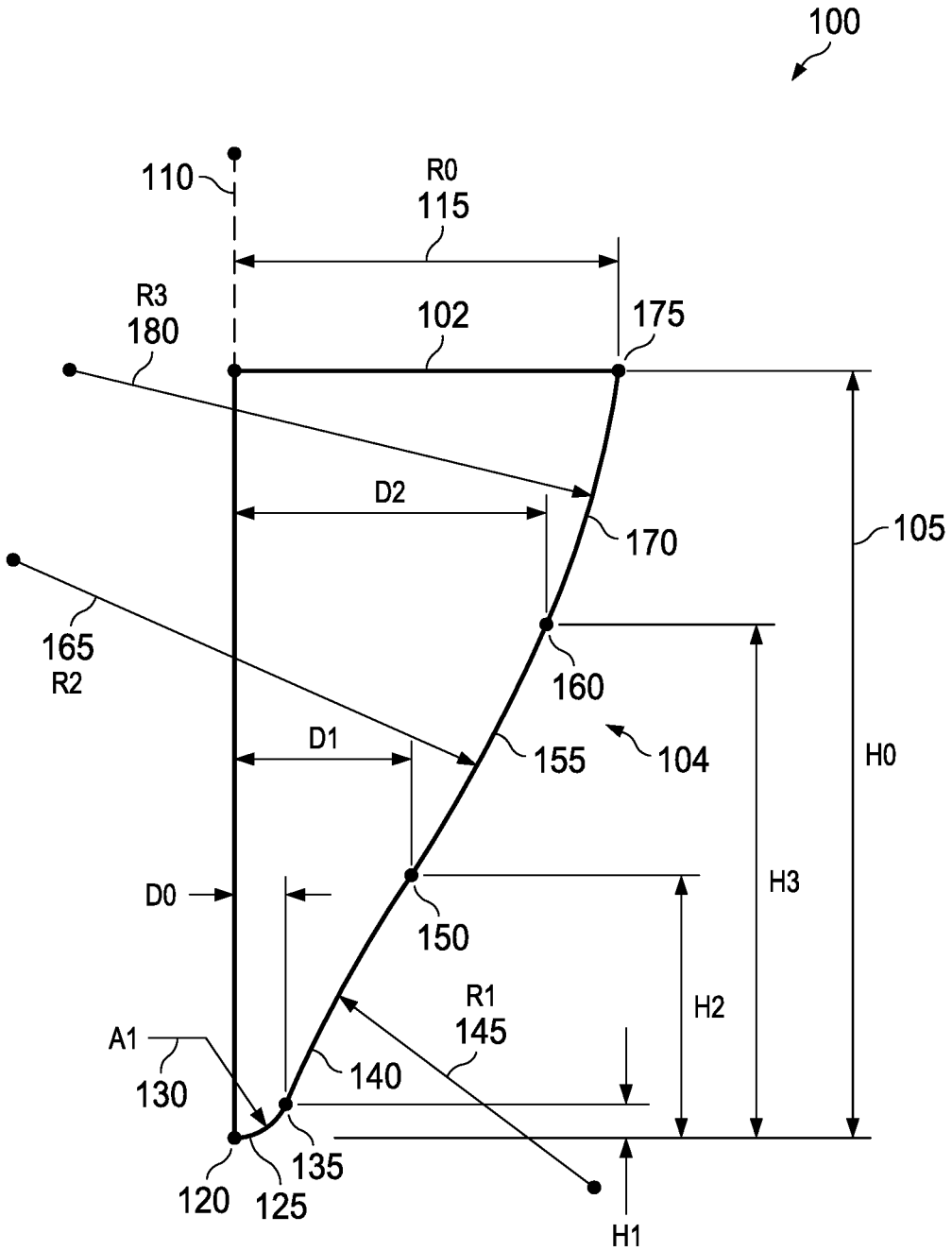
FIG. 2 is a schematic illustrating the various curvatures of a liner for a shaped charge in accordance with one or more examples described herein.

FIG. 2 is a schematic illustrating the various curvatures of a liner 100 for a shaped charge (e.g., shaped charge 25 as illustrated in FIG. 1). The liner 100 has a generally conical shape. The liner 100 comprises an open side 102; a liner wall, generally 104; an axis 110; and an apex 120. Open side 102 is the side of the liner 100 having an opening. Apex 120 is the apex of the liner 100 and is a terminal end of the liner 100. Liner wall 104 is the wall of the liner 100 and comprises several curvatures discussed below. The axis 110 extends through the center of the liner 100 from the apex 120 to the open side 102. Arrow 105 represents the height of the liner 100, illustrated and referred to as H0, and is the distance from the center of the open side 102 to the apex 120. The arrow 115 represents the largest radius of the liner 100 as it is measured at the open side 102. This radius of the liner 100, illustrated and referred to as R0, extends along a horizontal plane perpendicular to the axis 110 at the open side 102 and continues from the axis 110 to an outermost edge of the liner wall 104. Thus, the largest diameter of the liner 100 would be 2*R0. The ratio of the liner height, H0, to the largest diameter, 2*R0, is represented by equation 1:

$$H0/(2*R0) \quad \text{(Eq. 1)}$$

The ratio of the liner height, H0, to the largest diameter, 2*R0, of the liner 100 is in a range of about 0.90 to about 1.10.

H0 may be any height in a range from about 0.5 inch to about 4.5 inches. H0 may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values. For example, H0 may be about 0.5 inch, 1 inch, 1.5 inches, 2 inches, 2.5 inches, 3 inches, 3.5 inches, 4 inches, or 4.5 inches. With the benefit of this disclosure, one of ordinary skill in the art will be readily able to select an appropriate H0 for the liner for a desired application.

R0 may be any height in a range from about 0.25 inch to about 2.5 inches. R0 may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values. For example, R0 may be about 0.5 inch, 1 inch, 1.5 inches, 2 inches, or 2.5 inches. With the benefit of this disclosure, one of ordinary skill in the art will be readily able to select an appropriate R0 for the liner for a desired application.

The apex curvature 125 is a curvature around the apex 120. Apex curvature 125 is concave with respect to axis 110. The arrow 130 represents the radius of the apex curvature 125, and is illustrated and referred to as A1. The length of radius A1 is about 0.03 to about 0.12 times H0. The apex curvature 125 may extend to a first transition point 135. The apex curvature 125 has a maximum depth, illustrated and referred to as D0, that is the distance along a horizontal plane perpendicular to the axis 110 and that extends from the first transition point 135 to the axis 110. D0 is about 0.2 to about 0.12 times H0. The apex curvature 125 has a height, illustrated and referred to as H1, that is the distance along a vertical plane parallel to the axis 110, and that extends perpendicularly from the first transition point 135 to a horizontal plane extending from the apex 120. H1 is about 0.01 to about 0.09 times H0.

The first transition point 135 is the location where the apex curvature 125 transitions to another curvature, referred to as the first wall curvature 140. The first transition point 135 occurs where a circle drawn to complete the apex curvature 125 would intersect or be tangent to another circle drawn to complete the first wall curvature 140, the first wall curvature 140 being adjacent to the apex curvature 125.

The first wall curvature 140 is a curvature of the liner wall 104 that extends from the first transition point 135 to a second transition point 150. The first wall curvature 140 is adjacent to the apex curvature 125 as discussed above. The first wall curvature 140 is convex with respect to axis 110. The arrow 145 represents the radius of the first wall curvature 140, and is illustrated and referred to as R1. The length of radius R1 is about 1 to about 10 times the length of H0. The first wall curvature 140 has a maximum depth, illustrated and referred to as D1, which is the distance along a horizontal plane perpendicular to the axis 110 and that extends from the second transition point 150 to the axis 110. D1 is about 0.08 to about 0.40 times H0. The first wall curvature 140 has a height, illustrated and referred to as H2, that is the distance along a vertical plane parallel to the axis 110, and that extends perpendicularly from the second transition point 150 to a horizontal plane extending from the apex 120. H2 is about 0.35 to about 0.59 times H0.

The second transition point 150 is the location where the first wall curvature 140 transitions to another curvature, referred to as the second wall curvature 155. The second transition point 150 occurs where a circle drawn to complete the first wall curvature 140 would intersect or be tangent to another circle drawn to complete the second wall curvature 155, the second wall curvature 155 being adjacent to the first wall curvature 140.

The second wall curvature 155 is a curvature of the liner wall 104 that extends from the second transition point 150 to a third transition point 160. The second wall curvature 155 is adjacent to the first wall curvature 140 as discussed above. The arrow 165 represents the radius of the second wall curvature 155, and is illustrated and referred to as R2. The second wall curvature 155 may be concave or convex with respect to axis 110. In the illustration of FIG. 2, the second wall curvature 155 is concave with respect to the axis 110. As such, the radius R2 may be disposed on either side of the liner wall 104 (i.e., the interior side or the exterior side) depending on the desired orientation of the second wall curvature 155. The length of radius R2 is about 3 to about 30 times the length of H0. The second wall curvature 155 has a maximum depth, illustrated and referred to as D2, which is the distance along a horizontal plane perpendicular to the axis 110 and that extends from the third transition point 160 to the axis 110. D2 is about 0.18 to about 0.50 times H0. The second wall curvature 155 has a height, illustrated and referred to as H3, which is the distance along a vertical plane parallel to the axis 110, and that extends perpendicularly from the third transition point 160 to a horizontal plane extending from the apex 120. H3 is about 0.45 to about 0.69 times H0. The vertical distance between H2 and H3 is greater than 0.07 times H0.

The third transition point 160 is the location where the second wall curvature 155 transitions to another curvature, referred to as the third wall curvature 170. The third transition point 160 occurs where a circle drawn to complete the second wall curvature 155 would intersect or be tangent to another circle drawn to complete the third wall curvature 170, the third wall curvature 170 being adjacent to the second wall curvature 155.

The third wall curvature 170 is a curvature of the liner wall 104 that extends from the third transition point 160 to a fourth transition point 175. The fourth transition point 175 is located on the outermost edge of the open side 102 of the liner 100 and is a terminal end of the liner 100 such that the liner wall 104 does not extend past the fourth transition point 175. The third wall curvature 170 is concave with respect to the axis 110. The arrow 180 represents the radius of the third wall curvature 170, and is illustrated and referred to as R3. The length of radius R3 is about 1 to about 5 times the length of H0. As the third wall curvature 170 extends to the fourth transition point 175, located at the terminal end of the outermost edge of the open side 102 of the liner 100, the depth of the third wall curvature 170 is R0 and the height of the third wall curvature 170 is H0.

Figure 3:
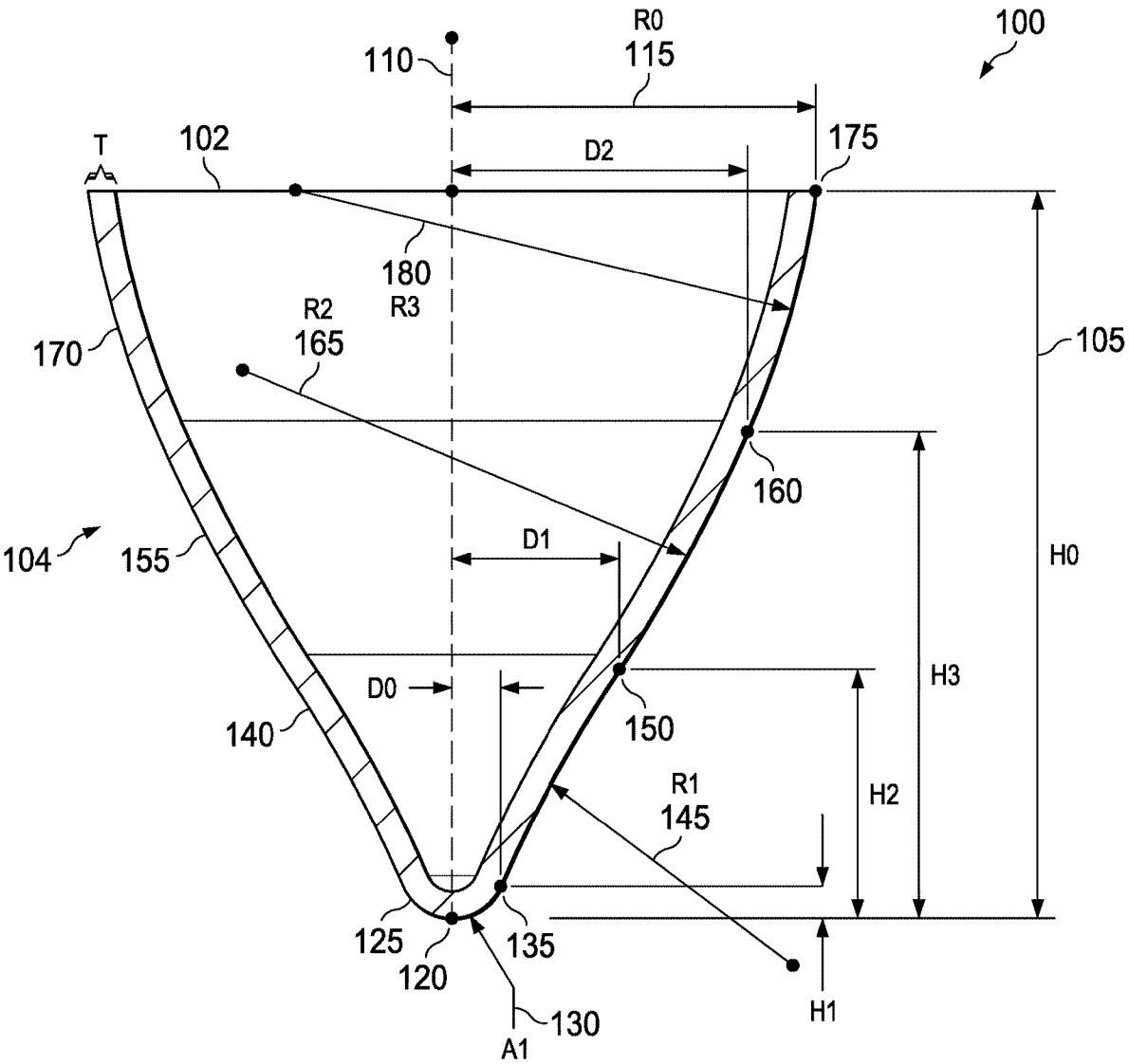
FIG. 3 is a cross-section illustrating the liner of FIG. 2 in accordance with one or more examples described herein.

FIG. 3 is a cross-section illustrating the liner 100 of FIG. 2. FIG. 3 illustrates the thickness of the liner 100, illustrated and referred to as T. T may vary along the length of liner 100 and may range from about 0.03 to about 0.10 times H0. T may have a taper or inverse taper depending upon the chosen perforating configuration of the perforating system (e.g., perforating system 5 as illustrated in FIG. 1). It is important to note that the measurements discussed above regarding the apex curvature 125, the first wall curvature 140, the second wall curvature 155, and the third wall curvature 170 are taken from the outermost portion of liner wall 104 as illustrated in FIG. 3.

Figure 4:
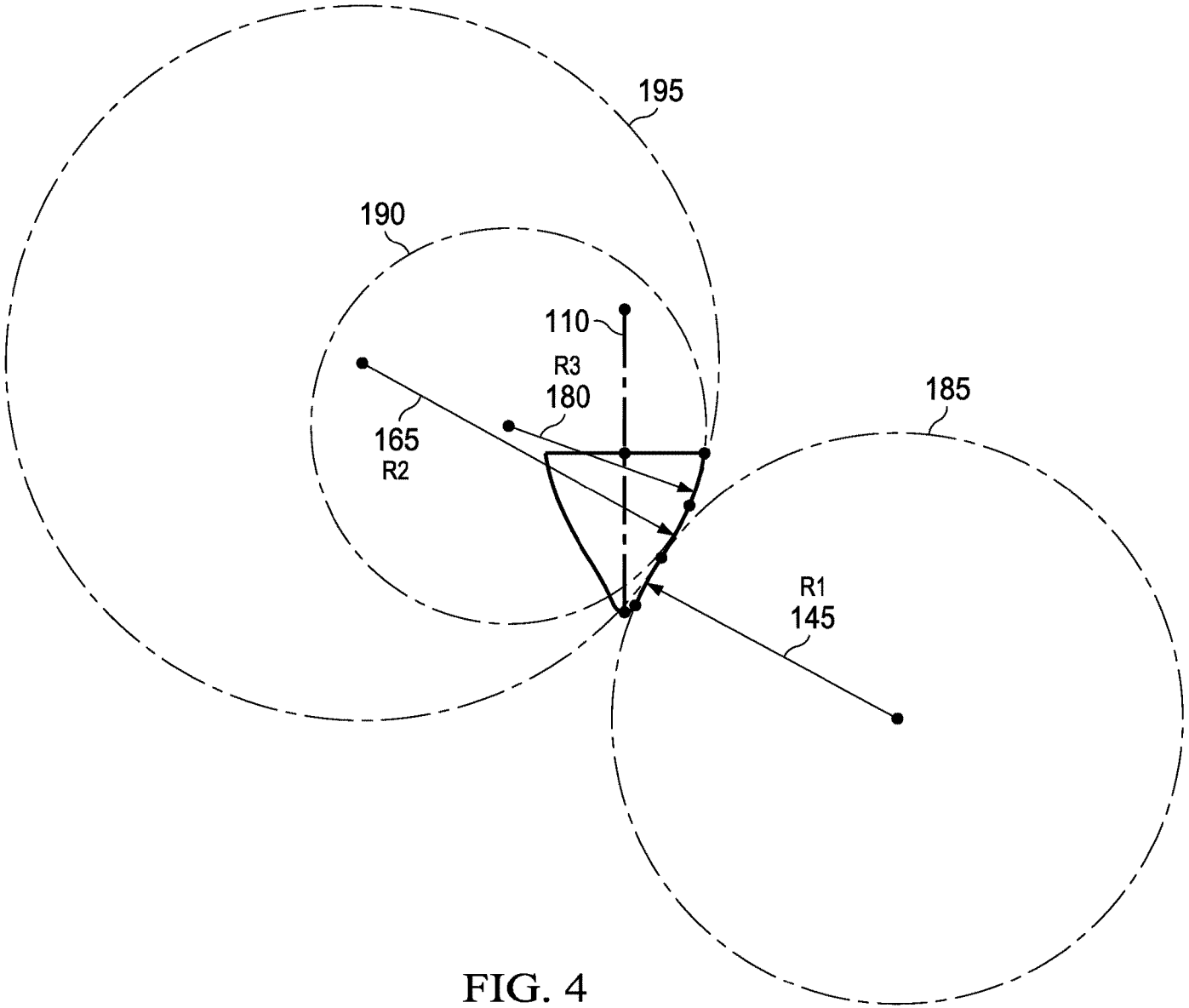
FIG. 4 is a schematic illustrating imaginary circles that may be drawn to complete the circular arcs of the various curvatures of the liner illustrated in FIGS. 2 and 3 in accordance with one or more examples described herein.

FIG. 4 is a schematic illustrating the previously referred to imaginary circles that may be drawn to complete the circular arcs of the first wall curvature 140, the second wall curvature 155, and the third wall curvature 170 as discussed above in reference to the liner 100 illustrated in FIGS. 2 and 3. For ease of illustration, the circle to complete the apex curvature 125 is not illustrated. Circle 185 is an imaginary circle that may be drawn to complete the circular arc of the first wall curvature 140. Circle 190 is an imaginary circle that may be drawn to complete the circular arc of the second wall curvature 155. Circle 195 is an imaginary circle that may be drawn to complete the circular arc of the third wall curvature 170.

The size of circle 185 is determined by the length of radius R1, represented by arrow 145, which is about 1 to about 10 times the length of H0. The circle 185 will be tangent to or intersect a circle (not illustrated) drawn to complete the apex curvature 125 at the first transition point 135, which was illustrated in FIG. 2. The circle 185 will be tangent to or intersect the circle 190 at the second transition point 150, which was illustrated in FIG. 2.

The size of the circle 190 is determined by the length of radius R2, represented by arrow 165, which is about 3 to about 30 times the length of H0. The circle 190 will be tangent to or intersect the circle 185 at the second transition point 150, which was illustrated in FIG. 2. The circle 190 will be tangent to or intersect the circle 195 at the third transition point 160, which was illustrated in FIG. 2. Second wall curvature 155 may be concave or convex with respect to the axis 110. In the illustration of FIG. 4, the second wall curvature 155 is concave with respect to the axis 110. As such, the radius R2 of the second wall curvature 155 may be disposed on either side of the liner wall 104 (i.e., the interior side or the exterior side) depending on the desired orientation of the second wall curvature 155. In the illustration of FIG. 4, radius R2 is depicted as disposed on the interior side of the liner wall 104. Positioning the radius R2 to the exterior side of the liner wall 104 would create a second wall curvature 155 that is convex with respect to the axis 110.

The size of the circle 195 is determined by the length of radius R3, represented by arrow 180, which is about 1 to about 5 times the length of H0. The circle 195 will be tangent to or intersect the circle 190 at the third transition point 160, which was illustrated in FIG. 2.

Figure 5:
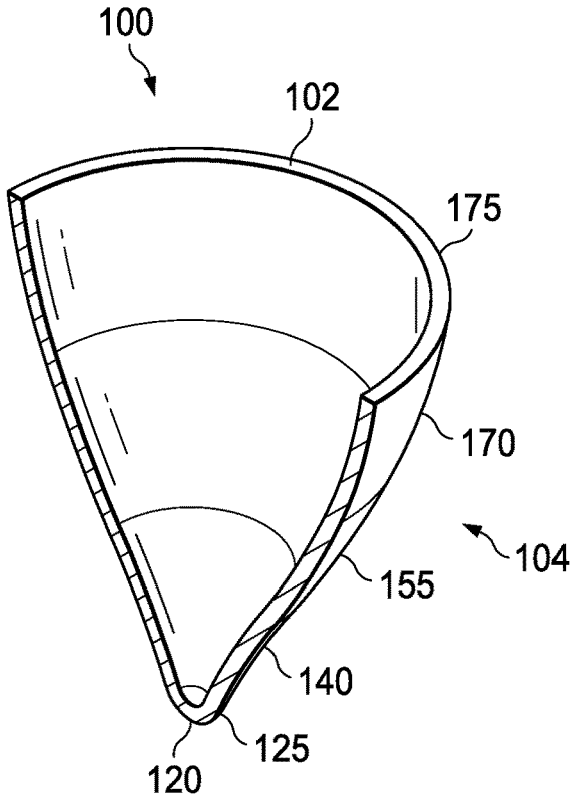
FIG. 5 is an isometric illustration of half of the liner illustrated in FIGS. 2-4 in accordance with one or more examples described herein.

FIG. 5 is an isometric illustration of half of the liner 100. FIG. 5 illustrates the interior geometry of liner 100 along its length. As illustrated, the first wall curvature 140, the second wall curvature 155, the third wall curvature 170, and the apex curvature 125 have an interior geometry, the degree of curvature of this interior geometry generally corresponds to the exterior geometry of the first wall curvature 140, the second wall curvature 155, the third wall curvature 170, and the apex curvature 125 as discussed above. The thickness of the liner wall 104 may vary along its length resulting in a taper or inverse taper along the interior of the liner wall 104.

Figure 6:
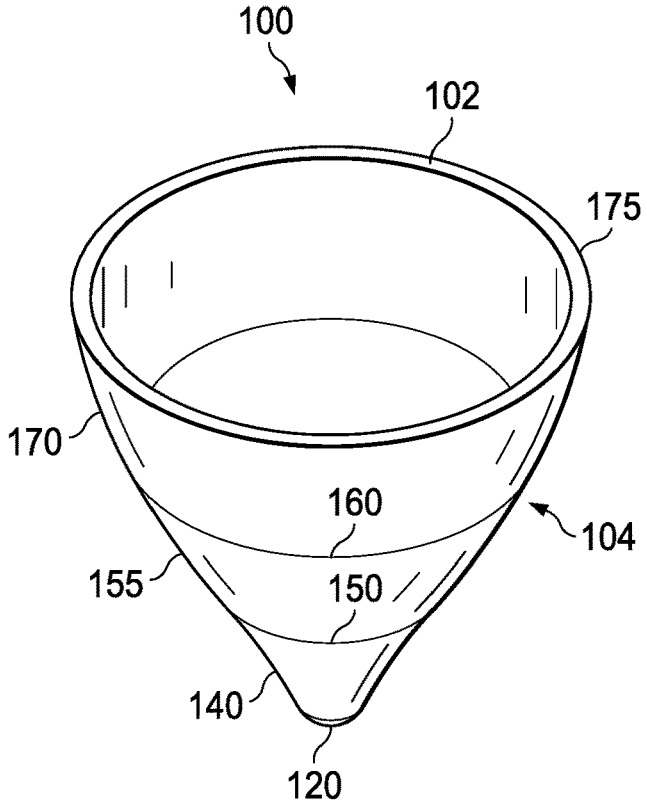
FIG. 6 is an isometric illustration of the entirety of the liner illustrated in FIGS. 2-5 in accordance with one or more examples described herein.

FIG. 6 is an isometric illustration of the entirety of liner 100. FIG. 6 illustrates the exterior geometry of liner 100 along its length. As illustrated, the first wall curvature 140, the second wall curvature 155, the third wall curvature 170, and the apex curvature 125 define the total exterior curvature of the liner wall 104 from its apex 120 to its terminal end on the exterior side of the open side 102 of the liner 100. This terminal end is represented by the fourth transition point 175. FIG. 6 further illustrates the first transition point 135, the second transition point 150, and the third transition point 160. As may be viewed from the illustration, the first transition point 135, the second transition point 150, and the third transition point 160 are the specific locations of the liner 100 in which there is a transition between curvatures (e.g., second transition point 150 is the point of transition between first wall curvature 140 and second wall curvature 155). The fourth transition point 175 is the specific location in which the third wall curvature 170 and the liner wall 104 ends.

The liner 100 may be fabricated by any sheet metal or powdered metal metallurgical processes. An example of a powdered metal metallurgical process is the unsintered cold-pressing of powdered metal alloys or pseudo-alloys to yield jets that are mainly composed of dispersed fine metal particles. These specific jets may not form solid slugs in some examples. Examples of metals and/or metal alloys which may be used to form the liner 100 include, but are not limited to, steel, copper, aluminum, tin, lead, brass, bismuth, zinc, silver, antimony, cobalt, nickel, molybdenum, tungsten, tantalum, uranium, cadmium, cobalt, magnesium, zirconium, beryllium, gold, platinum, depleted uranium, titanium, any alloys thereof, and any mixtures thereof. Additionally, in some optional examples, non-metal materials may be mixed in with the metals or metal alloys or used to form alloys or composites with the metals. These non-metal materials may include, but are not limited to, plastics, polymers, binders, lubricants, graphite, oil, or other additives. With the benefit of this disclosure one of ordinary skill in the art will be readily able to obtain and prepare materials sufficient for fabrication of the liner 100.

It should be clearly understood that the examples of liner 100 illustrated by FIGS. 2-6 are merely general applications of the principles of this disclosure in practice, and a wide variety of other examples are possible. Therefore, the scope of this disclosure is not limited in any manner to the details of FIGS. 2-6 as described herein.

Figure 7:
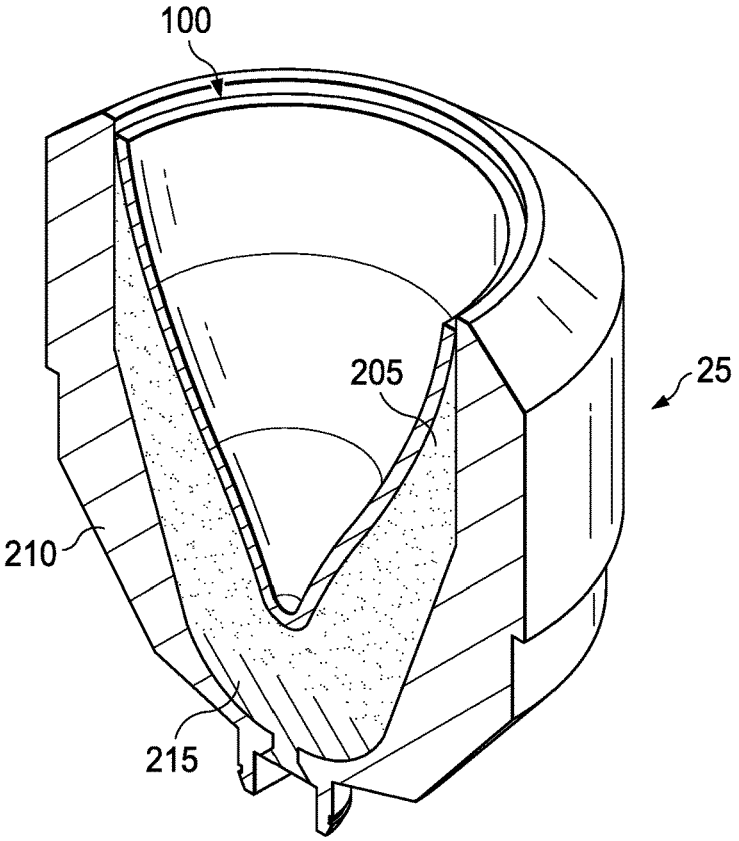
FIG. 7 is an isometric illustration of half of a shaped charge comprising the liner illustrated in FIGS. 2-6 in accordance with one or more examples described herein.

FIG. 7 is an isometric illustration of half of a shaped charge 25 comprising a liner 100 as disclosed herein. The shaped charge 25 comprises an explosive load 205 of energetic material. The shaped charge 25 further comprises a charge case 210 disposed adjacent to the explosive load 205. The shaped charge 25 further comprises a liner 100 disposed adjacent to the explosive load 205. The shaped charge 25 may be an open-faced charge as illustrated. The shaped charge 25 may further comprise a booster explosive 215. The booster explosive 215 may comprise a central booster, an array of boosters, a detonation wave guide, detonator, or any such detonation mechanism sufficient for detonating the explosive load 205. Detonation of the explosive load 205 generally comprises generating a supersonic exothermic front that accelerates so as to drive a shock front or wave propagating directly in front of the explosive load 205. A seal disc or detonation cord (not illustrated) may also be used with the booster explosive 215 in some examples. When desired for operation, the explosive load 205 is detonated using booster explosive 215. The force of the detonation collapses liner 100 causing liner 100 to be ejected from the shaped charge 25 in the form of a jet traveling at very high velocity toward, for example, a casing (e.g., casing 10 as illustrated in FIG. 1). The jet may penetrate the well casing, the cement, and/or the formation. When the jet penetrates the casing it forms a casing hole as discussed above. Due to the novel geometry of the liner 100, variation in the diameter of the casing hole may be reduced relative to other liners even in perforating systems that are decentralized, such as those described in FIG. 1.

Figure 8:
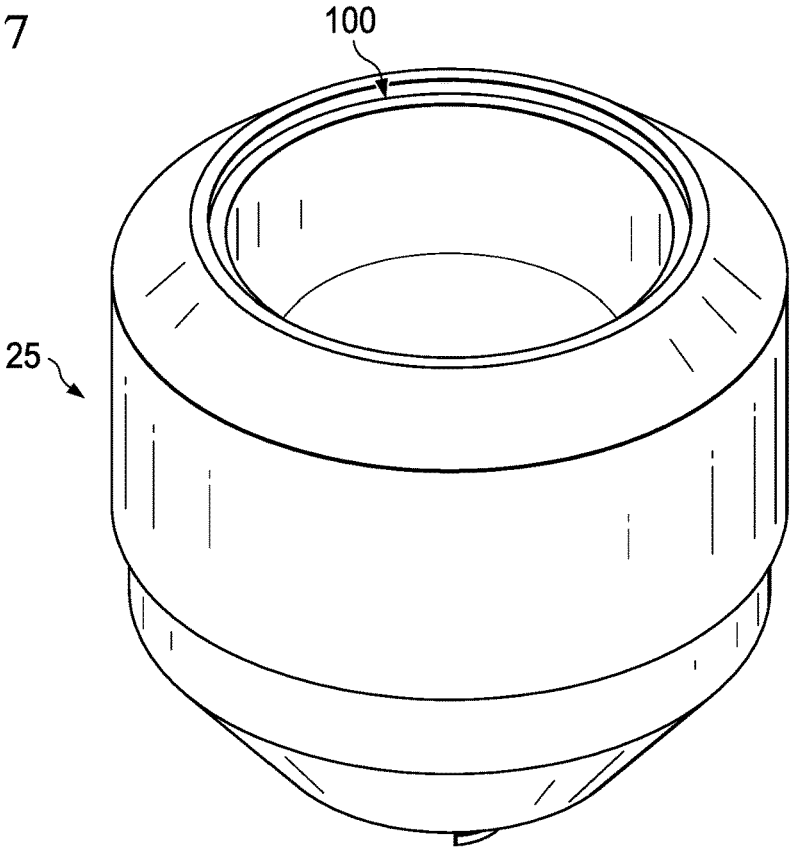
FIG. 8 is an isometric illustration of the entirety of the shaped charge of FIG. 7 in accordance with one or more examples described herein.

FIG. 8 is another isometric illustration of a shaped charge 25 comprising a liner 100 as disclosed herein. FIG. 8 illustrates the entirety of the shaped charge 25 described in FIG. 7 above (e.g., the exterior of the example charge case 210 is illustrated).

The charge case 210 may comprise a metal or metal alloy. The metal or metal alloy may include, but is not limited to, steel, aluminum, zinc, magnesium, titanium, tantalum, and combinations thereof. With the benefit of this disclosure, one of ordinary skill in the art will be readily able to obtain and prepare a charge case 210 sufficient for a desired application.

The explosive load 205 comprises an energetic material. The energetic material may include, but is not limited to, [3-Nitrooxy-2,2-bis(nitrooxymethyl)propyl]nitrate "hereafter PETN"; 1,3,5-Trinitroperhydro-1,3,5-triazine "hereafter RDX"; Octahydro-1,3,5,7-tetranitro-1,3,5,7-tetrazocine "hereafter HMX"; 1,3,5-Trinitro-2-[2-(2,4,6-trinitrophenyl) ethenyl]benzene "hereafter HNS"; 2,6-bis,bis(picrylamino)-3,5-dinitropyridine "hereafter PYX"; 1,3,5-trinitro-2,4,6-tripicrylbenzene "hereafter BRX"; 2,2',2",4,4',4",6,6',6"-nonanitro-m-terphenyl "hereafter NONA"; and any combination thereof. In some optional examples, the explosive load 205 may further comprise a de-sensitizing material. The de-sensitizing material may be capable of binding the main explosive load 205 together. The de-sensitizing material may also help the main explosive load 205 retain its shape. The de-sensitizing material may include, but is not limited to, wax, graphite, plastics, thermoplastics, fluoropolymers (e.g., polytetrafluoroethylene), other non-energetic (inert) binders, and any combination thereof. With the benefit of this disclosure, one of ordinary skill in the art will be readily able to obtain and prepare an explosive load 205 sufficient for a desired application.

It should be clearly understood that the examples of the shaped charge 25 illustrated by FIGS. 7-8 are merely general applications of the principles of this disclosure in practice, and a wide variety of other examples are possible. Therefore, the scope of this disclosure is not limited in any manner to the details of FIGS. 7-8 as described herein.

As discussed above, the geometry of the example liners described herein (e.g., liner 100 described in FIGS. 2-8) allows for a reduction in the variation in the casing hole diameter in decentralized perforating systems. In some examples, the disclosed liners may provide a casing hole diameter variation in the range of between about 1% to about 8%. As such, the diameter among two or more casing holes may vary in size between about 1% to about 8%. In other examples, the casing hole diameter variation may be in a range of about 2% to about 7%. In still further examples, the casing hole diameter variation may be in a range of about 2% to about 6%.

It is also to be recognized that the disclosed methods and systems may also directly or indirectly affect the various downhole equipment and tools that may contact components of the methods and systems disclosed herein. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the methods and systems generally described above and depicted in FIGS. 1-8.

Provided are liners for a shaped charge in accordance with the disclosure and the illustrated FIGs. An example liner comprises a generally conical shape having an apex, an open side, a liner wall comprising a thickness, and an axis extending through the center of the liner from the apex to the center of the open side. The liner is characterized in that it comprises: a liner height extending in a vertical plane from the center of the open side to the apex, a liner radius extending along a horizontal plane that is perpendicular to the axis at the open side of the liner, and that extends from the axis to an outermost edge of the liner wall; wherein the ratio of the liner height to the liner diameter is about 0.90 to about 1.10. The liner wall comprises an apex curvature, a first wall curvature, a second wall curvature, a third wall curvature, a first transition point, a second transition point, a third transition point, and a fourth transition point; wherein the apex curvature extends between the apex and the first transition point; wherein the first wall curvature extends between the first transition point and the second transition point; wherein the second wall curvature extends between the second transition point and the third transition point and is adjacent to the first wall curvature and the third wall curvature; and wherein the third wall curvature extends between the third transition point and the fourth transition point. The first wall curvature is convex with respect to the axis and comprises: a first wall curvature radius that is about 1 to about 10 times the length of the liner height, a first wall curvature depth that is the distance along a horizontal plane perpendicular to the axis and that extends from the second transition point to the axis, the first wall curvature depth being about 0.08 to about 0.40 times the liner height, and a first wall curvature height that is the distance along a vertical plane parallel to the axis and that extends perpendicularly from the second transition point to a horizontal plane extending from the apex; the first wall curvature height being about 0.35 to about 0.59 times the liner height; The second wall curvature is concave or convex with respect to the axis and comprises: a second wall curvature radius that is about 3 to about 30 times the length of the liner height, a second wall curvature depth that is the distance along a horizontal plane perpendicular to the axis and that extends from the third transition point to the axis, the second wall curvature depth being about 0.18 to about 0.5 times the liner height, and a second wall curvature height that is the distance along a vertical plane parallel to the axis and that extends perpendicularly from the third transition point to a horizontal plane extending from the apex, the second wall curvature height being about 0.45 to about 0.69 times the liner height. The third wall curvature is concave with respect to the axis and comprises: a third wall curvature radius that is about 1 to about 5 times the length of the liner height.

Additionally or alternatively, the liner may include one or more of the following features individually or in combination. The vertical distance between the first wall curvature height and the second wall curvature height may be greater than 0.07 times the liner height. The second wall curvature may be concave with respect to the axis. The second wall curvature may be convex with respect to the axis. The apex curvature may be concave with respect to the axis and is adjacent to the first wall curvature. The apex curvature may comprise an apex curvature radius that is about 0.03 to about 0.12 times the liner height. The apex curvature may comprise an apex curvature height that is the distance along a vertical plane parallel to the axis and that extends perpendicularly from the first transition point to a horizontal plane extending from the apex, the apex curvature height being about 0.01 to about 0.09 times the liner height; The liner may comprise a metal or metal alloy selected from the group consisting of steel, copper, aluminum, tin, lead, brass, bismuth, zinc, silver, antimony, cobalt, nickel, molybdenum, tungsten, tantalum, uranium, cadmium, cobalt, magnesium, zirconium, beryllium, gold, platinum, depleted uranium, titanium, and any combination thereof. The liner may be disposed in the shaped charge. The ratio of the liner height to the liner diameter may be about 0.95 to about 1.05; wherein the first wall curvature radius is about 1.5 to about 5 times the length of the liner height; wherein the first wall curvature depth is about 0.16 to about 0.33 times the liner height; wherein the first wall curvature height is about 0.35 to about 0.52 times the liner height; wherein the second wall curvature radius is about 10 to about 18 times the length of the liner height; wherein the second wall curvature depth is 0.25 to about 0.44 times the liner height; wherein the second wall curvature height is about 0.52 to about 0.69 times the liner height; and wherein the third wall curvature radius is about 1 to about 3 times the length of the liner height.

Provided are methods for perforating a casing in accordance with the disclosure and the illustrated FIGs. An example method comprises providing a carrier containing a shaped charge; wherein the shaped charge comprises: a charge case, an explosive load, and a liner. The liner comprising a generally conical shape having an apex, an open side, a liner wall comprising a thickness, and an axis extending through the center of the liner from the apex to the center of the open side. The liner is characterized in that it comprises a liner height extending in a vertical plane from the center of the open side to the apex, a liner radius extending along a horizontal plane that is perpendicular to the axis at the open side of the liner, and that extends from the axis to an outermost edge of the liner wall; wherein the ratio of the liner height to the liner diameter is about 0.90 to about 1.10. The liner wall comprises an apex curvature, a first wall curvature, a second wall curvature, a third wall curvature, a first transition point, a second transition point, a third transition point, and a fourth transition point; wherein the apex curvature extends between the apex and the first transition point; wherein the first wall curvature extends between the first transition point and the second transition point; wherein the second wall curvature extends between the second transition point and the third transition point and is adjacent to the first wall curvature and the third wall curvature; and wherein the third wall curvature extends between the third transition point and the fourth transition point. The first wall curvature is convex with respect to the axis and comprises a first wall curvature radius that is about 1 to about 10 times the length of the liner height, a first wall curvature depth that is the distance along a horizontal plane perpendicular to the axis and that extends from the second transition point to the axis, the first wall curvature depth being about 0.08 to about 0.40 times the liner height, and a first wall curvature height that is the distance along a vertical plane parallel to the axis and that extends perpendicularly from the second transition point to a horizontal plane extending from the apex; the first wall curvature height being about 0.35 to about 0.59 times the liner height. The second wall curvature is concave or convex with respect to the axis and comprises a second wall curvature radius that is about 3 to about 30 times the length of the liner height, a second wall curvature depth that is the distance along a horizontal plane perpendicular to the axis and that extends from the third transition point to the axis, the second wall curvature depth being about 0.18 to about 0.5 times the liner height, and a second wall curvature height that is the distance along a vertical plane parallel to the axis and that extends perpendicularly from the third transition point to a horizontal plane extending from the apex, the second wall curvature height being about 0.45 to about 0.69 times the liner height. The third wall curvature is concave with respect to the axis and comprises a third wall curvature radius that is about 1 to about 5 times the length of the liner height. The method further comprises positioning the carrier in the casing disposed in a wellbore penetrating a subterranean formation and detonating the shaped charge to perforate the casing thereby providing a casing hole.

Additionally or alternatively, the method may include one or more of the following features individually or in combination. The vertical distance between the first wall curvature height and the second wall curvature height may be greater than 0.07 times the liner height. The second wall curvature may be concave with respect to the axis. The second wall curvature may be convex with respect to the axis. The apex curvature may be concave with respect to the axis and is adjacent to the first wall curvature. The apex curvature may comprise an apex curvature radius that is about 0.03 to about 0.12 times the liner height. The apex curvature may comprise an apex curvature height that is the distance along a vertical plane parallel to the axis and that extends perpendicularly from the first transition point to a horizontal plane extending from the apex, the apex curvature height being about 0.01 to about 0.09 times the liner height; The liner may comprise a metal or metal alloy selected from the group consisting of steel, copper, aluminum, tin, lead, brass, bismuth, zinc, silver, antimony, cobalt, nickel, molybdenum, tungsten, tantalum, uranium, cadmium, cobalt, magnesium, zirconium, beryllium, gold, platinum, depleted uranium, titanium, and any combination thereof. The liner may be disposed in the shaped charge. The ratio of the liner height to the liner diameter may be about 0.95 to about 1.05; wherein the first wall curvature radius is about 1.5 to about 5 times the length of the liner height; wherein the first wall curvature depth is about 0.16 to about 0.33 times the liner height; wherein the first wall curvature height is about 0.35 to about 0.52 times the liner height; wherein the second wall curvature radius is about 10 to about 18 times the length of the liner height; wherein the second wall curvature depth is 0.25 to about 0.44 times the liner height; wherein the second wall curvature height is about 0.52 to about 0.69 times the liner height; and wherein the third wall curvature radius is about 1 to about 3 times the length of the liner height. The carrier may be decentralized in the casing. The carrier may comprise a plurality of shaped charges; wherein the shaped charges are detonated to perforate the casing to provide a plurality of casing holes. The plurality of shaped charges may be arranged such that the distance from at least two of the individual shaped charges in the plurality to the casing is different. The individual casing holes in the plurality may comprise a casing hole diameter; wherein the casing hole diameter variation is in a range of between about 1% to about 8%.

Provided are systems for perforating a casing in accordance with the disclosure and the illustrated FIGs. An example system comprises the casing and a carrier disposed within the casing. The carrier comprises a shaped charge; the shaped charge comprising: a charge case, an explosive load, and a liner. The liner comprises a generally conical shape having an apex, an open side, a liner wall comprising a thickness, and an axis extending through the center of the liner from the apex to the center of the open side. The liner is characterized in that it comprises: a liner height extending in a vertical plane from the center of the open side to the apex, a liner radius extending along a horizontal plane that is perpendicular to the axis at the open side of the liner, and that extends from the axis to an outermost edge of the liner wall; wherein the ratio of the liner height to the liner diameter is about 0.90 to about 1.10. The liner wall comprises an apex curvature, a first wall curvature, a second wall curvature, a third wall curvature, a first transition point, a second transition point, a third transition point, and a fourth transition point; wherein the apex curvature extends between the apex and the first transition point; wherein the first wall curvature extends between the first transition point and the second transition point; wherein the second wall curvature extends between the second transition point and the third transition point and is adjacent to the first wall curvature and the third wall curvature; and wherein the third wall curvature extends between the third transition point and the fourth transition point. The first wall curvature is convex with respect to the axis and comprises: a first wall curvature radius that is about 1 to about 10 times the length of the liner height, a first wall curvature depth that is the distance along a horizontal plane perpendicular to the axis and that extends from the second transition point to the axis, the first wall curvature depth being about 0.08 to about 0.40 times the liner height, and a first wall curvature height that is the distance along a vertical plane parallel to the axis and that extends perpendicularly from the second transition point to a horizontal plane extending from the apex; the first wall curvature height being about 0.35 to about 0.59 times the liner height; The second wall curvature is concave or convex with respect to the axis and comprises: a second wall curvature radius that is about 3 to about 30 times the length of the liner height, a second wall curvature depth that is the distance along a horizontal plane perpendicular to the axis and that extends from the third transition point to the axis, the second wall curvature depth being about 0.18 to about 0.5 times the liner height, and a second wall curvature height that is the distance along a vertical plane parallel to the axis and that extends perpendicularly from the third transition point to a horizontal plane extending from the apex, the second wall curvature height being about 0.45 to about 0.69 times the liner height. The third wall curvature is concave with respect to the axis and comprises: a third wall curvature radius that is about 1 to about 5 times the length of the liner height.

Additionally or alternatively, the system may include one or more of the following features individually or in combination. The vertical distance between the first wall curvature height and the second wall curvature height may be greater than 0.07 times the liner height. The second wall curvature may be concave with respect to the axis. The second wall curvature may be convex with respect to the axis. The apex curvature may be concave with respect to the axis and is adjacent to the first wall curvature. The apex curvature may comprise an apex curvature radius that is about 0.03 to about 0.12 times the liner height. The apex curvature may comprise an apex curvature height that is the distance along a vertical plane parallel to the axis and that extends perpendicularly from the first transition point to a horizontal plane extending from the apex, the apex curvature height being about 0.01 to about 0.09 times the liner height; The liner may comprise a metal or metal alloy selected from the group consisting of steel, copper, aluminum, tin, lead, brass, bismuth, zinc, silver, antimony, cobalt, nickel, molybdenum, tungsten, tantalum, uranium, cadmium, cobalt, magnesium, zirconium, beryllium, gold, platinum, depleted uranium, titanium, and any combination thereof. The liner may be disposed in the shaped charge. The ratio of the liner height to the liner diameter may be about 0.95 to about 1.05; wherein the first wall curvature radius is about 1.5 to about 5 times the length of the liner height; wherein the first wall curvature depth is about 0.16 to about 0.33 times the liner height; wherein the first wall curvature height is about 0.35 to about 0.52 times the liner height; wherein the second wall curvature radius is about 10 to about 18 times the length of the liner height; wherein the second wall curvature depth is 0.25 to about 0.44 times the liner height; wherein the second wall curvature height is about 0.52 to about 0.69 times the liner height; and wherein the third wall curvature radius is about 1 to about 3 times the length of the liner height. The carrier may be decentralized in the casing. The carrier may comprise a plurality of shaped charges; wherein the shaped charges are detonated to perforate the casing to provide a plurality of casing holes. The plurality of shaped charges may be arranged such that the distance from at least two of the individual shaped charges in the plurality to the casing is different. The individual casing holes in the plurality may comprise a casing hole diameter; wherein the casing hole diameter variation is in a range of between about 1% to about 8%.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A liner for a shaped charge, the liner comprising:

a generally conical shape having an apex, an open side, a liner wall comprising a thickness, and an axis extending through the center of the liner from the apex to the center of the open side, the liner being characterized in that it comprises:

a liner height extending in a vertical plane from the center of the open side to the apex, a liner radius extending along a horizontal plane that is perpendicular to the axis at the open side of the liner, and that extends from the axis to an outermost edge of the liner wall; wherein the ratio of the liner height to the liner diameter is about 0.90 to about 1.10;

wherein the liner wall comprises an apex curvature, a first wall curvature, a second wall curvature, a third wall curvature, a first transition point, a second transition point, a third transition point, and a fourth transition point; wherein the apex curvature extends between the apex and the first transition point; wherein the first wall curvature extends between the first transition point and the second transition point; wherein the second wall curvature extends between the second transition point and the third transition point and is adjacent to the first wall curvature and the third wall curvature; and wherein the third wall curvature extends between the third transition point and the fourth transition point;

wherein the first wall curvature is convex with respect to the axis and comprises:

a first wall curvature radius that is about 1 to about 10 times the length of the liner height, a first wall curvature depth that is the distance along a horizontal plane perpendicular to the axis and that extends from the second transition point to the axis, the first wall curvature depth being about 0.08 to about 0.40 times the liner height, and a first wall curvature height that is the distance along a vertical plane parallel to the axis and that extends perpendicularly from the second transition point to a horizontal plane extending from the apex; the first wall curvature height being about 0.35 to about 0.59 times the liner height;

wherein the second wall curvature is concave or convex with respect to the axis and comprises:

a second wall curvature radius that is about 3 to about 30 times the length of the liner height, a second wall curvature depth that is the distance along a horizontal plane perpendicular to the axis and that extends from the third transition point to the axis, the second wall curvature depth being about 0.18 to about 0.5 times the liner height, and a second wall curvature height that is the distance along a vertical plane parallel to the axis and that extends perpendicularly from the third transition point to a horizontal plane extending from the apex, the second wall curvature height being about 0.45 to about 0.69 times the liner height;

wherein the third wall curvature is concave with respect to the axis and comprises:

a third wall curvature radius that is about 1 to about 5 times the length of the liner height.

2. The liner of claim 1, wherein the vertical distance between the first wall curvature height and the second wall curvature height is greater than 0.07 times the liner height.

3. The liner of claim 1, wherein the second wall curvature is concave with respect to the axis.

4. The liner of claim 1, wherein the second wall curvature is convex with respect to the axis.

5. The liner of claim 1, wherein the apex curvature is concave with respect to the axis and is adjacent to the first wall curvature.

6. The liner of claim 1, wherein the apex curvature comprises an apex curvature radius that is about 0.03 to about 0.12 times the liner height.

7. The liner of claim 1, wherein the apex curvature comprises an apex curvature height that is the distance along a vertical plane parallel to the axis and that extends perpendicularly from the first transition point to a horizontal plane extending from the apex, the apex curvature height being about 0.01 to about 0.09 times the liner height.

8. The liner of claim 1, wherein the liner comprises a metal or metal alloy selected from the group consisting of steel, copper, aluminum, tin, lead, brass, bismuth, zinc, silver, antimony, cobalt, nickel, molybdenum, tungsten, tantalum, uranium, cadmium, cobalt, magnesium, zirconium, beryllium, gold, platinum, depleted uranium, titanium, and any combination thereof.

9. The liner of claim 1, wherein the liner is disposed in the shaped charge.

10. The liner of claim 1, wherein the ratio of the liner height to the liner diameter is about 0.95 to about 1.05; wherein the first wall curvature radius is about 1.5 to about 5 times the length of the liner height; wherein the first wall curvature depth is about 0.16 to about 0.33 times the liner height; wherein the first wall curvature height is about 0.35 to about 0.52 times the liner height; wherein the second wall curvature radius is about 10 to about 18 times the length of the liner height; wherein the second wall curvature depth is 0.25 to about 0.44 times the liner height; wherein the second wall curvature height is about 0.52 to about 0.69 times the liner height; and wherein the third wall curvature radius is about 1 to about 3 times the length of the liner height.

11. A method for perforating a casing comprising:

providing a carrier containing a shaped charge; wherein the shaped charge comprises:

a charge case, an explosive load, and a liner; wherein the liner comprises:

a generally conical shape having an apex, an open side, a liner wall comprising a thickness, and an axis extending through the center of the liner from the apex to the center of the open side, the liner being characterized in that it comprises:

a liner height extending in a vertical plane from the center of the open side to the apex, a liner radius extending along a horizontal plane that is perpendicular to the axis at the open side of the liner, and that extends from the axis to an outermost edge of the liner wall; wherein the ratio of the liner height to the liner diameter is about 0.90 to about 1.10;

wherein the liner wall comprises an apex curvature, a first wall curvature, a second wall curvature, a third wall curvature, a first transition point, a second transition point, a third transition point, and a fourth transition point; wherein the apex curvature extends between the apex and the first transition point; wherein the first wall curvature extends between the first transition point and the second transition point; wherein the second wall curvature extends between the second transition point and the third transition point and is adjacent to the first wall curvature and the third wall curvature; and wherein the third wall curvature extends between the third transition point and the fourth transition point;

wherein the first wall curvature is convex with respect to the axis and comprises:

a first wall curvature radius that is about 1 to about 10 times the length of the liner height, a first wall curvature depth that is the distance along a horizontal plane perpendicular to the axis and that extends from the second transition point to the axis, the first wall curvature depth being about 0.08 to about 0.40 times the liner height, and a first wall curvature height that is the distance along a vertical plane parallel to the axis and that extends perpendicularly from the second transition point to a horizontal plane extending from the apex; the first wall curvature height being about 0.35 to about 0.59 times the liner height;

wherein the second wall curvature is concave or convex with respect to the axis and comprises:

a second wall curvature radius that is about 3 to about 30 times the length of the liner height, a second wall curvature depth that is the distance along a horizontal plane perpendicular to the axis and that extends from the third transition point to the axis, the second wall curvature depth being about 0.18 to about 0.5 times the liner height, and a second wall curvature height that is the distance along a vertical plane parallel to the axis and that extends perpendicularly from the third transition point to a horizontal plane extending from the apex, the second wall curvature height being about 0.45 to about 0.69 times the liner height;

wherein the third wall curvature is concave with respect to the axis and comprises:

a third wall curvature radius that is about 1 to about 5 times the length of the liner height;

positioning the carrier in the casing disposed in a wellbore penetrating a subterranean formation;

detonating the shaped charge to perforate the casing thereby providing a casing hole.

12. The method of claim 11, wherein the carrier is decentralized in the casing.

13. The method of claim 11, wherein the carrier comprises a plurality of shaped charges; wherein the shaped charges are detonated to perforate the casing to provide a plurality of casing holes.

14. The method of claim 13, wherein the plurality of shaped charges are arranged such that the distance from at least two of the individual shaped charges in the plurality to the casing is different.

15. The method of claim 14, wherein the individual casing holes in the plurality comprise a casing hole diameter; wherein the casing hole diameter variation is in a range of between about 1% to about 8%.

16. A system for perforating a casing comprising:

the casing, and a carrier disposed within the casing and containing a shaped charge; the shaped charge comprising:

a charge case, an explosive load, and a liner; wherein the liner comprises:

a generally conical shape having an apex, an open side, a liner wall comprising a thickness, and an axis extending through the center of the liner from the apex to the center of the open side, the liner being characterized in that it comprises:

a liner height extending in a vertical plane from the center of the open side to the apex, a liner radius extending along a horizontal plane that is perpendicular to the axis at the open side of the liner, and that extends from the axis to an outermost edge of the liner wall; wherein the ratio of the liner height to the liner diameter is about 0.90 to about 1.10;

wherein the liner wall comprises an apex curvature, a first wall curvature, a second wall curvature, a third wall curvature, a first transition point, a second transition point, a third transition point, and a fourth transition point; wherein the apex curvature extends between the apex and the first transition point; wherein the first wall curvature extends between the first transition point and the second transition point; wherein the second wall curvature extends between the second transition point and the third transition point and is adjacent to the first wall curvature and the third wall curvature; and wherein the third wall curvature extends between the third transition point and the fourth transition point;

wherein the first wall curvature is convex with respect to the axis and comprises:

a first wall curvature radius that is about 1 to about 10 times the length of the liner height, a first wall curvature depth that is the distance along a horizontal plane perpendicular to the axis and that extends from the second transition point to the axis, the first wall curvature depth being about 0.08 to about 0.40 times the liner height, and a first wall curvature height that is the distance along a vertical plane parallel to the axis and that extends perpendicularly from the second transition point to a horizontal plane extending from the apex; the first wall curvature height being about 0.35 to about 0.59 times the liner height;

wherein the second wall curvature is concave or convex with respect to the axis and comprises:

a second wall curvature radius that is about 3 to about 30 times the length of the liner height, a second wall curvature depth that is the distance along a horizontal plane perpendicular to the axis and that extends from the third transition point to the axis, the second wall curvature depth being about 0.18 to about 0.5 times the liner height, and a second wall curvature height that is the distance along a vertical plane parallel to the axis and that extends perpendicularly from the third transition point to a horizontal plane extending from the apex, the second wall curvature height being about 0.45 to about 0.69 times the liner height;

wherein the third wall curvature is concave with respect to the axis and comprises:

a third wall curvature radius that is about 1 to about 5 times the length of the liner height.

17. The system of claim 16, wherein the carrier is decentralized in the casing.

18. The system of claim 17, wherein the carrier comprises a plurality of shaped charges; wherein the plurality of shaped charges are arranged such that the distance from at least two of the individual shaped charges in the plurality to the casing is different.

19. The system of claim 16, wherein the liner comprises a metal or metal alloy selected from the group consisting of steel, copper, aluminum, tin, lead, brass, bismuth, zinc, silver, antimony, cobalt, nickel, molybdenum, tungsten, tantalum, uranium, cadmium, cobalt, magnesium, zirconium, beryllium, gold, platinum, depleted uranium, titanium, and any combination thereof.

20. The system of claim 16, wherein the explosive load comprises an energetic material selected from the group consisting of [3-Nitrooxy-2,2-bis(nitrooxymethyl)propyl] nitrate; 1,3,5-Trinitroperhydro-1,3,5-triazine; Octahydro-1,3,5,7-tetranitro-1,3,5,7-tetrazocine; 1,3,5-Trinitro-2-[2-(2,4,6-trinitrophenyl)ethenyl]benzene; 2,6-bis,bis(picrylamino)-3,5-dinitropyridine; 1,3,5-trinitro-2,4,6-tripicrylbenzene; 2,2',2",4,4',4",6,6',6"-nonanitro-m-terphenyl; and any combination thereof.

* * * * *